United States Patent [19]

Williams et al.

[11] Patent Number: 4,831,758

[45] Date of Patent: May 23, 1989

[54] JUKEBOX DISPLAY UNIT

[75] Inventors: Bernhard O. Williams, Elmhurst; Arthur R. Harth, Chicago, both of Ill.

[73] Assignee: Seeburg Phonograph Corporation, Addison, Ill.

[21] Appl. No.: 235,697

[22] Filed: Aug. 22, 1988

Related U.S. Application Data

[63] Continuation of Ser. No. 926,014, Oct. 31, 1986.

[51] Int. Cl.[4] ..... G09F 11/30

[52] U.S. Cl. ..... 40/510; 40/389; 40/532; 40/537; 40/405

[58] Field of Search ..... 40/530–533, 40/510, 511, 516, 517, 388, 389, 390, 497, 405

[56] References Cited

U.S. PATENT DOCUMENTS

| | | | |
|---|---|---|---|
| 189,980 | 4/1877 | Williamson | 40/531 |
| 500,099 | 6/1893 | George | 30/389 |
| 501,857 | 7/1893 | Williams | 40/532 |
| 525,719 | 9/1894 | Ray | 40/531 |
| 950,006 | 2/1910 | McCarty | 211/162 |
| 963,336 | 7/1910 | Tas | 40/510 |
| 1,207,456 | 12/1916 | Whelan | 40/533 |
| 1,405,076 | 1/1922 | Tiffany | 40/510 |
| 2,449,462 | 9/1948 | Erisman | 40/531 |
| 2,545,362 | 3/1951 | Kenney | 40/389 |
| 2,791,848 | 5/1957 | Neilsen | 40/389 |
| 3,220,128 | 11/1965 | Clement et al. | 40/389 |
| 3,268,868 | 8/1966 | Rockola | 40/389 |
| 3,412,496 | 11/1968 | Hendricks et al. | 40/389 |
| 3,616,556 | 11/1971 | Williams | 40/526 |
| 3,739,509 | 6/1973 | O'Neil | 40/371 |
| 3,964,192 | 6/1976 | Nonaka | 40/389 |
| 4,275,519 | 6/1981 | Grunstad | 40/389 |

FOREIGN PATENT DOCUMENTS 1036622 3/1963 United Kingdom .

*Primary Examiner*—John J. Wilson
*Assistant Examiner*—Michael Lynch
*Attorney, Agent, or Firm*—Wood, Dalton, Phillips, Mason & Rowe

[57] ABSTRACT

A CD jukebox display unit is disclosed for displaying the program information on CD covers. The unit includes a housing adapted for mounting to a jukebox and having a transparent front portion. A plurality of frames adapted to support a compact disc cover are supported within the housing for pivoting about spaced and substantially parallel axes slanted rearwardly in the rear of the housing. A horizontal track is provided adjacent the housing front portion and supports a slide member which carries a knob biased forwardly therefrom. A finger is secured to the knob and projects rearwardly therefrom so that when the knob is pushed rearwardly, the finger engages a selected one of the tabs provided on each of the support frames.

13 Claims, 1 Drawing Sheet

JUKEBOX DISPLAY UNIT

This application is a continuation of application Ser. No. 926,014, filed Oct. 31, 1986.

DESCRIPTION

TECHNICAL FIELD

The present invention relates to jukeboxes, and more particularly to display units for the musical selections available for applying on a jukebox.

BACKGROUND ART

Jukeboxes are, of course, well known in the art. Commonly these have involved singles (records having the single songs on each side) which can be played by a user entering an appropriate code in the jukebox. These jukeboxes have commonly listed the song titles and artists' names only, and a user browses through that list to find a song he wishes to hear, and to find the code which will play that song.

This type of jukebox display can, however, "lose business" since potential users frequently will not recognize a song which they like by its title alone, and space constraints limit the amount of information which has been provided.

The present invention is directed toward overcoming one or more of the problems as set forth above.

SUMMARY OF THE INVENTION

In one aspect of the present invention, a CD jukebox display unit is disclosed for displaying the program information on CD covers. The unit includes a housing adapted for mounting a jukebox and having a transparent front portion. A plurality of frames adapted to support a compact disc cover are supported within the housing for pivoting about spaced and substantially parallel axes slanted rearwardly in the rear of the housing. A horizontal track is provided adjacent the housing front portion and supports a slide member which carries a knob biased forwardly therefrom. A finger is secured to the knob and projects rearwardly therefrom so that when the knob is pushed rearwardly, the finger engages a selected one of the tabs provided on each of the support frames.

The present invention allows a jukebox user to browse through numerous CD covers in order to determine what music is available for hearing and to determine how to request a particular selection. The present invention is extremely easy to use, which is a particularly important feature inasmuch as many individuals will use the jukebox only a few times (since these jukeboxes are commonly not owned by individuals in their homes). Further, while providing simple use, the structure allows for a large number of disc covers to be displayed in a compact area, still another important feature with jukeboxes inasmuch as only limited space can typically be provided for such displays.

With the recent advent of the component disc technology, high quality sound can now be provided through a jukebox. However, the compact discs which are available for use in such jukeboxes are usually complete albums (that is, each disc will commonly have eight to ten songs by a single artist). With the present invention, each compact disc cover can be fully displayed to show information on all of the artists' songs on a particular disc. Additionally, the present invention provides an indexing feature so that a user can initially identify many covers without being forced to blindly flip through them all. Further, the eye-catching graphics used to sell the compact disc is also therefore used to attract the attention (and business) of a potential jukebox user. Still further, the complete information provided by the covers serves to increase a potential user's recognition of a particular song title, and thereby enhance the chance of each song being selected.

DESCRIPTION OF THE PREFERRED EMBODIMENT

Figure 1:
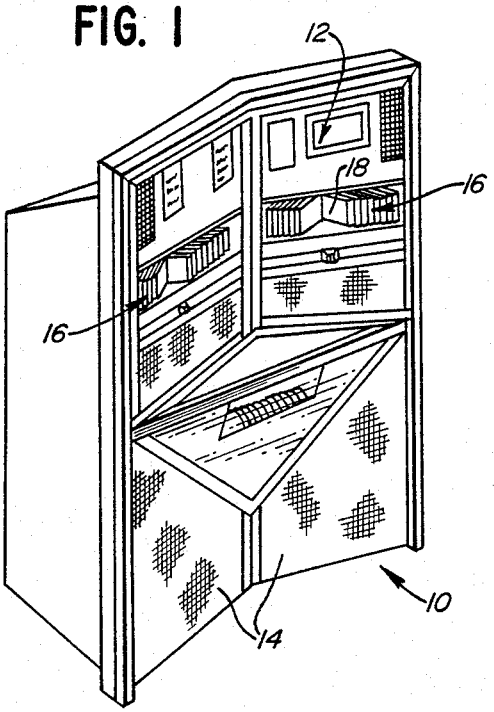
FIG. 1 is a perspective view of a compact disc jukebox having two display units.

A compact disc jukebox 10 having a design as shown in U.S. patent application Ser. No. 918,805, filed Oct. 14, 1986 and entitled "Jukebox Design", is shown in FIG. 1. The jukebox 10 includes a control panel 12, speakers 14, and display units 16, these display units 16 being the subject of this application.

The display units 16 are mounted within the jukebox and include a transparent front face 18 (made of, e.g., suitable glass or plastic). This enables a jukebox user to view the various CD covers 20 mounted therein to determine what music is available for hearing and to determine how to request a particular selection.

Each display unit 16 is preferably mounted in its own housing 22, which can be mounted in the jukebox 10 as a unit. The top of the housing 22 may include a translucent portion (not shown) through which lighting may be provided to appropriately light the unit.

Figure 4:
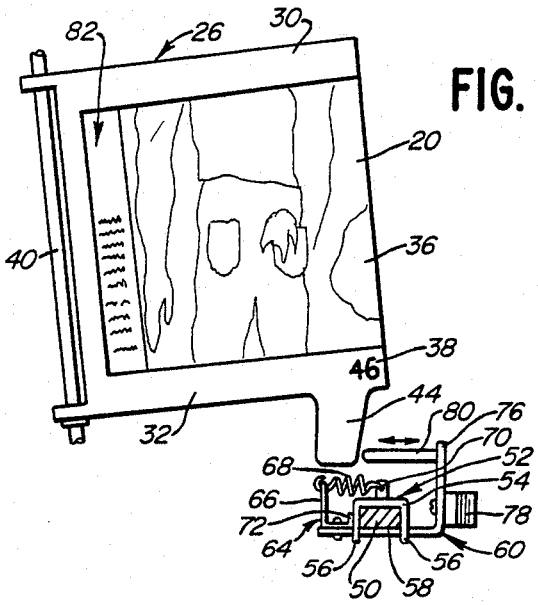
FIG. 4 is a partial cross-sectional view taken along line 4—4 of FIG. 2.

Each display unit 16 includes a plurality of C-shaped frames 26, each having channels 28 defined in the upper and lower legs 30,32 to support two CD covers 20 back-to-back therein. A rigid backing plate 36 (see FIG. 4) is also preferably provided in each frame 26 to provide adequate support to prevent the covers 20 (which are typically single page illustrations with program information thereon) from sagging. Still other frames suitable for supporting CD covers 20 (using, for example, tabs instead of channels) could also be used within the scope of the present invention.

Numbers 38 or other suitable identifying data are preferably provided on the frames 26 to allow a user to interface the information on the covers 20 with the jukebox control panel 12.

The frames 26 are suitably supported for pivoting about axes defined by, e.g., shafts 40 mounted in the rear of the housing 22. These shafts 40 are preferably uniformly spaced and substantially parallel for proper functioning of the display unit 16.

Preferably, the shafts 40 should be slanted rearwardly (with the shaft top rearward from the shaft bottom) so that weight of the frame 26 will bias the frame 26 toward pivoting to one side or the other. This also allows the frame 26 to be tipped so that the covers 20 face up as well as forward in the jukebox 10, and thus are more easily seen (since most users' eyes are higher than the unit 16). A slant for the shaft 40 of around 30° has been found to work well, although other angles might be chosen depending on the particular jukebox involved.

The display unit 16 accordingly supports the CD covers somewhat like a large book, and two covers 20 can be displayed at any one time by simply flipping "pages".

Each frame 26 has a downwardly tab 44. An appropriately positioned rod 48 (see FIG. 3) is preferably mounted in the housing 22 so as to engage the tabs 44 to prevent the covers 20 and frames 26 from banging into each other when the "pages" are flipped.

Inasmuch as the transparent front face 18 is provided to prevent users from touching the covers 20 (both preserving the covers 20 and preventing theft), a structure enabling a user to pivot the frames 26 is provided as hereinafter described.

A track 50 is suitably suppoted adjacent the front of the housing 20. The track 50 is essentially a longitudinal bar with a rectangular cross-section. A slide member 52 (consisting essentially of a U-shaped bracket 54) rides on the track 50. The downwardly depending legs 56 of the bracket 54 have matched openings therein through which is slidably received one leg 58 of an L-shaped bracket 60.

An end member 64 is suitably secured to the end of the one leg 58 of the L-shaped bracket 60. The longer leg 66 of the end member 64 is connected by a tension spring 68 to a flange 70 on the slide member 52 so that the L-shaped bracket 60 is biased forward (to the right in FIG. 4). The shorter leg 72 of the end member 64 acts as a stop to limit forward travel of the L-shaped bracket 60.

The other leg 76 of the L-shaped bracket 60 is substantially upright and has a handle or knob 78 thereon, the knob 78 projecting forwardly to give a user access. The upright leg 76 of the L-shaped bracket 60 supports a rearwardly projecting finger 80 which will engage the frame tabs 44 (which are effectively spaced by the spacing of their supporting shafts 40) when moved rearwardly and slid sideways.

Accordingly, a jukebox user can browse through the numerous covers 20 by sliding the knob 78 to the tab 44 associated with a selected frame 26, push the knob 78 in, and then slide the knob 78 to turn the frame 26 (the finger 80 engaging the tab 44 when the knob 78 is pushed in).

Figure 2:
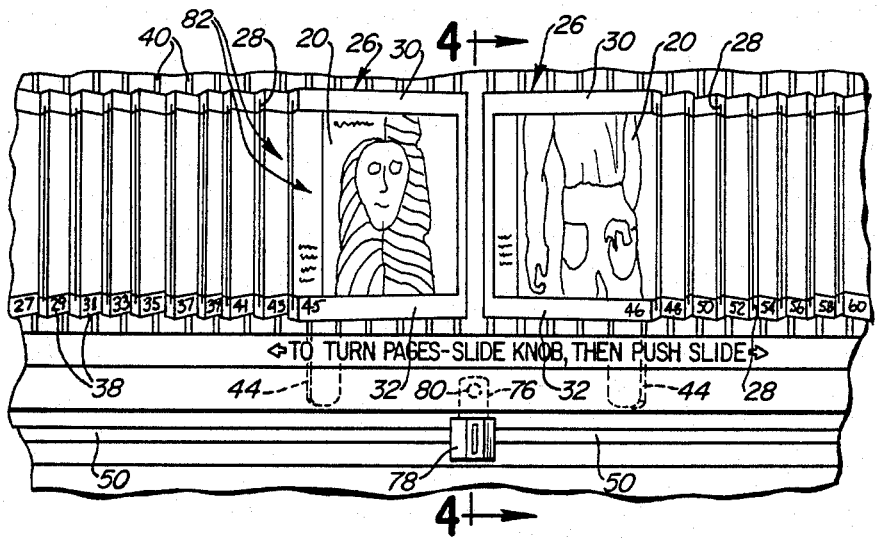
FIG. 2 is a partial front view of the display unit.

Further, inasmuch as the program information (i.e. artist and titles) on the CD covers 20 is generally printed down one side margin (indicated generally by reference no. 82 in FIGS. 2 and 4), the configuration of the unit 10 provides an indexing features allowing a user to initially identify many covers 20 other than the two open "pages". That is, as best seen in FIG. 2, the covers 20 on the left identified by the odd identifying numbers less than "45" have their program information exposed so that a user could flip immediately to, e.g., identifying numbers "31" and "32" knowing that "31" is a Tina Turner CD.

Figure 3:
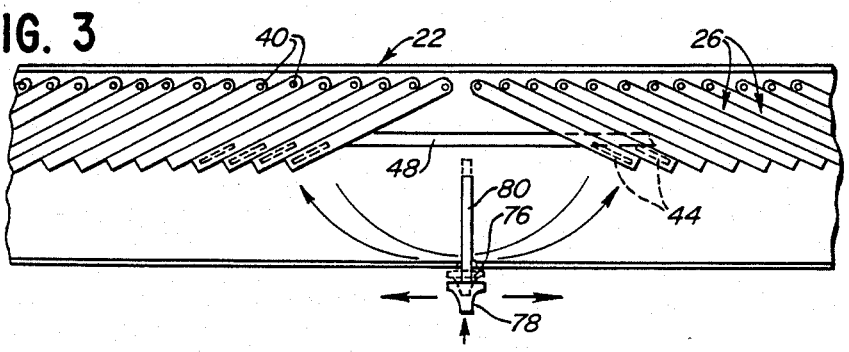
FIG. 3 is a top view of the display unit illustrating its operation.

It will be noted, particularly from FIG. 3, that in the mid-point of turning pages, the finger 80 will remain engaged with the tab 44 (due to the forward portion of motion of the tab 44 during pivoting) so that a "page" will not slip free even if the user should slip and not keep the knob 78 pushed in.

Accordingly, this structure enables a large number of disc covers to be displayed in a compact area, where operation of the display is extremely simple for the user.

Other aspects, objects and advantages of the invention can be obtained from a study of the drawings, the specification and the appended claims.

We claim:

1. A display unit for the selections available for heating on a jukebox, comprising:

a housing adapted for mounting to a jukebox and including a transparent front face;

a plurality of frames interchangeably supporting graphic displays of available selections, each frame having a tab thereon;

spaced and substantially parallel shafts slanted rearwardly in the housing;

means for pivotally attaching one of the frames to each of a plurality of the shafts to that the tabs on the frames attached to the shafts are laterally spaced from each other;

a track extending substantially horizontally;

a slide member;

means for attaching the slide member to the track for substantially horizontal sliding movement relative to the track;

a knob carrying a rearwardly projecting finger;

means for mounting the knob to the slide member for movement relative to the slide member in a rearward and forward direction between a tab engagement position and a tab release position, respectively, said finger on the knob situated in overlapping relationship in a fore and aft direction with a plurality of said frame tabs with the knob in said tab engagement position, and said finger situated forwardly of the plurality of said frame tabs with the knob in the tab release position so that the knob can be slid along the track without interference between the knob finger and any of the plurality of tabs when in the tab release position; and means for baising the knob to the release position, whereby a user can slide the knob horizontally without engagement between the knob finger and tabs until the knob is in front of a desired selection and thereafter urge the knob rearwardly against the biasing means to place the finger and a tab on the desired selection in fore and aft overlapping relationship and slide the knob horizontally to engage the knob finger with the tab and thereby pivot the frame supporting the desired selection to examine the desired selection.

2. The display unit fo claim 1, wherein said shafts are slanted rearwardly at substantially a 30° angle.

3. The display unit of claim 1, further comprising a rod mounted in the housing and adapted to engage the frame tabs to limit their pivoting.

4. The display unit of claim 1, further comprising a translucent portion in the housing adapted to diffuse lighting into the unit.

5. The display unit of claim 1, wherein the frames defines upper and lower channels for supporting graphic displays along their edges with substantially all of the graphic displays exposed.

6. A CD jukebox display unit for the program information on compact disc covers, comprising:

a housing with a transparent front portion;

means for mounting the housing to a CD jukebox;

a plurality of support frames, each frame having a tab projecting therefrom and having means for supporting a compact disc cover with the program information thereon exposed;

means for supporting said frames within said housing in laterally spaced relationship for pivoting about spaced and substantially parallel axes slanted rearwardly at the rear of the housing; and means for allowing manual pivoting of said frames including a track extending substantially horizontally adjacent the housing front portion, a slide member movable along said track, a control knob, means for mounting the control knob to the slide member for movement horizontally with the slide member and for movement in a rearward and forward direction relative to the slide member between a tab engagement position and a tab release position respectively, and a finger on the knob projecting rearwardly therefrom, said finger with the knob in the tab engagement position residing in overlapping relationship in a fore and aft direction with a plurality of the frame tabs and, with the knob in the tab release position said finger residing in non-overlapping relationship in a fore and aft direction with the frame tabs, whereby a user can slide the knob horizontally without engagement between the knob finger and tabs until the knob is in front of a desired selection and thereafter urge the knob rearwardly to place the finger and a tab on the desired selection in fore and aft overlapping relationship and slide the knob horizontally to engage the knob finger with the tab and pivot the frame supporting the desired selection to examine the desired selection.

7. The display unit of claim 6, wherein the slide member slidably receives a bracket leg secured to the knob, and further comprising means for biasing said bracket leg forwardly relative to said slide member.

8. The display unit of claim 7, wherein the track is substantially rectangular in cross-section and the slide member is a U-shaped bracket thereon.

9. The display unit of claim 6, wherein said axes are slanted rearwardly at substantially a 30° angle.

10. The display unit of claim 6, further comprising a rod mounted in the housing and adapted to engage the frame tabs to limit their pivoting.

11. The display unit of claim 10, wherein the pivot limit prevents the frames from covering selected side margins of adjacent frames.

12. The display unit of claim 6, further comprising a translucent portion in the housing adapted to diffuse lighting into the unit.

13. The display unit of claim 6, wherein the frames defines upper and lower channels for supporting graphic displays along their edges with substantially all of the graphic displays exposed.

* * * * *